United States Patent [19]

Kobiella

[11] 4,011,807

[45] Mar. 15, 1977

[54] STRAP FEEDING AND TENSIONING MACHINE

[75] Inventor: Robert J. Kobiella, Rolling Meadows, Ill.

[73] Assignee: Signode Corporation, Glenview, Ill.

[22] Filed: Jan. 21, 1976

[21] Appl. No.: 650,923

[52] U.S. Cl. ..... 100/2; 100/26; 100/29; 100/32

[51] Int. Cl.[2] ..... B65B 13/02

[58] Field of Search ..... 100/2, 4, 26, 29, 32, 100/33 R, 33 PB; 140/93.2, 93.4, 93.6; 226/143

[56] References Cited

UNITED STATES PATENTS

| | | | |
|---|---|---|---|
| 2,880,667 | 4/1959 | Parkes et al. | 100/29 |
| 3,420,158 | 1/1969 | Kobiella | 100/2 |
| 3,442,203 | 5/1969 | Kobiella | 100/26 |
| 3,566,778 | 3/1971 | Vilcins | 100/2 |

*Primary Examiner*—Billy J. Wilhite
*Attorney, Agent, or Firm*—Dressler, Goldsmith, Clement, Gordon & Shore, Ltd.

[57] ABSTRACT

A strap feeding and tensioning machine is disclosed wherein strap is fed at a high rate of speed about a package so as to form a loop which is then tensioned and subsequently can be sealed. The loop is formed so that the leading end of the strap is overlapped by a trailing end of the strap and the resulting overlapped strap portions are joined together by means of an external seal, by friction fusion, or in any other convenient manner. The feeding and tensioning mechanism comprises a rotatable winder drum equipped with a pair of arcuate feed guide means, a feed wheel rotatably mounted on the winder drum, and reversible driving means for the winder drum and the feed wheel.

18 Claims, 6 Drawing Figures

STRAP FEEDING AND TENSIONING MACHINE

BACKGROUND OF THE INVENTION

This invention relates to a strap feeding and tensioning mechanism which feeds strap around an article or a package and thereafter tensions the fed strap. After a loop is formed and tensioned, the strap ends are secured by a joint or seal.

It is known to tie packages of various shapes and configurations by means of thermoplastic strap. While such strap can be secured in place using an external seal which is crimped about overlapping strap regions, or by the so-called hot knife method, in many instances it is more desirable to secure the strap by fusing together the overlapping strap ends by the generation of heat in situ by the rapid relative movement of overlapping strap portions which are biased toward one another by externally applied pressure. Joints formed in the foregoing manner are commonly referred to as friction-fused joints.

In many packaging applications it is desirable to feed strap at a relatively high rate about a package and to pull considerable tension on the strap that has been looped about a package; however, convenient means for the rapid feeding of strap about a package and subsequent pulling of relatively high tension in the strap looped about a package heretofore have not been available.

SUMMARY OF THE INVENTION

The present invention provides a strapping machine and method whereby strap can be looped at a high rate of speed about a package, subsequently tensioned at a relatively high torque within a relatively short time period, and thereafter the formed, tensioned loop can be rapidly sealed by means of a friction-fused joint or in any other convenient manner.

To form a strap loop the strap is fed from a supply roll at a high rate of speed through appropriate guideways about the package to be strapped and then tensioned at a relatively high torque. Once a sufficient length of strap has been dispensed and disposed as a loop about the package so that the trailing strap end overlaps the leading strap end, a region of the leading strap end is gripped and held in the apparatus while the rotational direction of driving motor is reversed to draw tension on the strap and to form a tensioned loop about the package. After the desired tension has been drawn, an overlapping region of both strap ends is gripped so as to retain tension in the loop, the previously imposed grip on the leading strap end is released, tension is released on the free trailing strap end, and the latter is severed from the strap supply. While the formed strap loop is maintained under tension, the overlapping strap ends are sealed or joined together.

The strap feeding and tensioning function is performed by a mechanism which includes a rotatable winder drum equipped with a pair of communicating feed guide means, preferably arcuate and having substantially opposite curvatures, a strap feed wheel rotatably mounted on the winder drum, preferably so that the axis of rotation of the strap feed wheel is substantially parallel to the axis of rotation of the winder drum, a relatively high-speed feed wheel driving means, and relatively low-speed winder drum driving means. The first of the aforementioned feed guide means receives strap from the strap supply and directs the received strap in engagement with the strap feed wheel. The second feed guide means guides the received strap out of engagement with the strap feed wheel and towards a strap guideway which directs the strap so as to form a loop about the package. The second feed guide means can be further provided with a friction surface along a portion thereof for frictionally engaging the strap during the tensioning step, if desired. Optionally, the winder drum can be provided with an outer strap guide means.

To form the tensioned loop, strap from a supply roll is directed into the winder drum and about the strap feed wheel via the first feed guideway means, the feed wheel is then driven at a high rate, and the strap is fed about the feed wheel, out of the winder drum via the second feed guideway means, and about the package to be strapped. After a sufficient length of strap has been payed out to form the desired loop about the package, strap feed is interrupted, the leading end of the strap segment loop about the package is held, the direction of rotation for the strap feed wheel is reversed for a time period sufficient to take up slack in the formed loop, and the winder drum is rotated at a relatively slow rate to pull the desired tension in the strap forming a loop about the package by winding excess strap about the external surface of the drum. When the desired tension has been pulled, rotation of the winder drum is stopped, overlapping ends of the strap loop are gripped so as to maintain tension in the loop, tension is relaxed in the strap segment between the winder drum and the gripped region, and the trailing end of the strap segment forming the loop about the package is severed from the strap supply roll. At this point in time the leading and trailing ends of the strap loop are in an overlapping position and are ready to be joined together. Alternatively, the strap ends can be sealed first and the loop severed from the strap supply roll thereafter.

In cases where metal strap is utilized, the overlapping strap portions can be joined by means of a crimped seal, a spot weld, or similar expedients. For thermoplastic strap, on the other hand, it is preferred to join the overlapping strap segments together by means of a friction-fused joint or by the hot knife technique.

DESCRIPTION OF THE PREFERRED EMBODIMENTS

Figure 1:
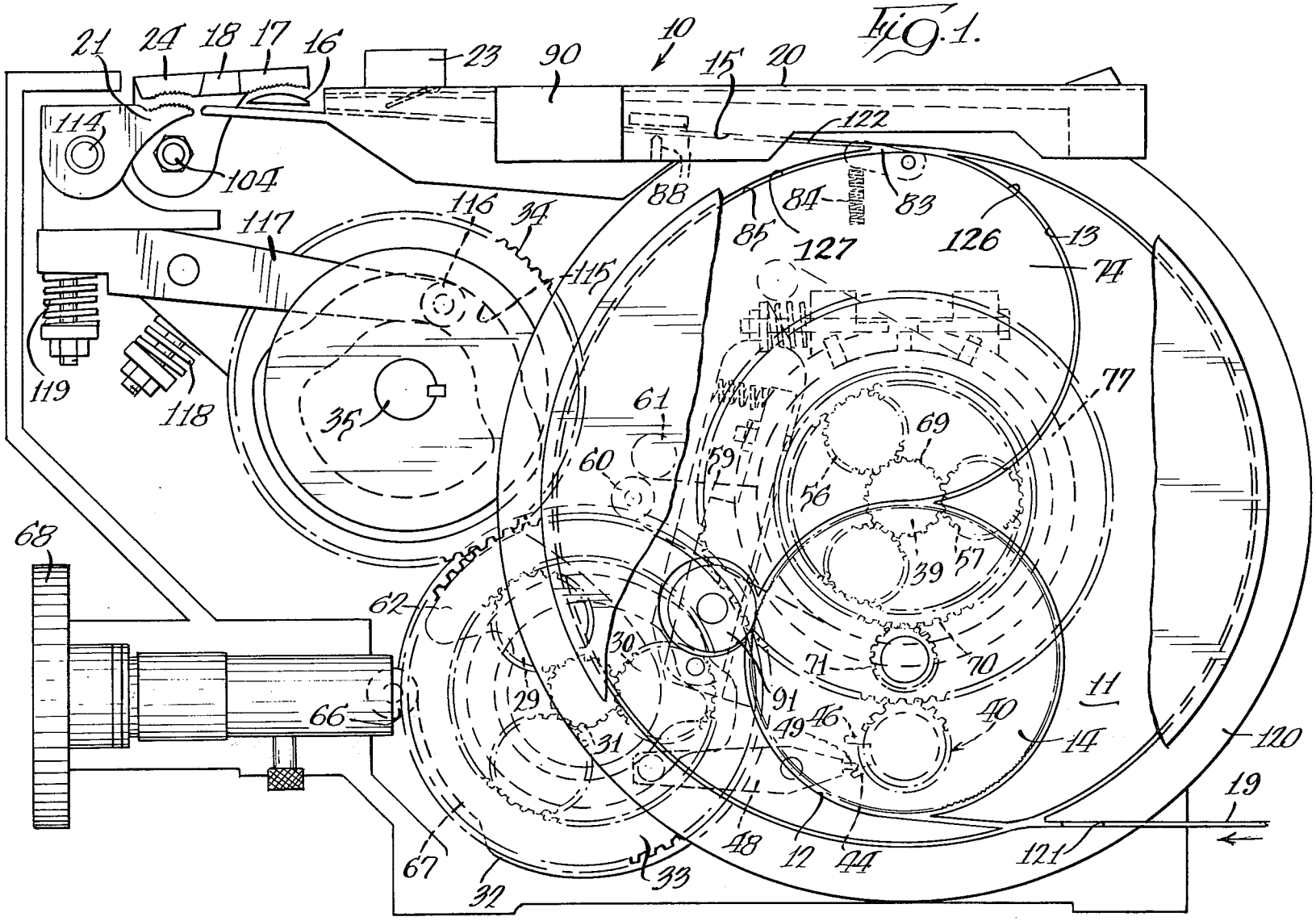
FIG. 1 is a front elevational view of a strapping apparatus embodying the present invention, parts thereof being broken away to show internal construction.

The strap feeding and tensioning machine shown in the drawings includes a strap feeding and tensioning mechanism which is driven by a reversible electric motor, or a similar prime mover, through an appropriate power transmission means. While a differential-type power transmission means is illustrated, other power transmission means can be utilized to drive the feeding and tensioning mechanism.

Referring generally to FIG. 1, the strap feeding and tensioning mechanism of strapping apparatus 10 includes rotatable winder drum 11 provided with arcuate strap feed guideways 12 and 13 which communicate with each other but have opposite curvatures, and with outer strap guide 120 which is an annular ring surrounding the peripheral winding surface of winder drum 11, but spaced therefrom. Additionally, high-speed strap feed wheel 14 is rotatably mounted on winder drum or spool 11 and revolves about the axis of winder drum 11 as the latter rotates. The axis of rotation of feed wheel 14 is substantially parallel to but spaced from the axis of rotation of winder drum 11.

Strap 19 to be looped about a package, or the like, is directed into winder drum 11 and passes therethrough via arcuate strap feed guideways 12 and 13 before entering strap guide 15 from whence it passes through strap sealing mechanism 90 which can be a friction-fusion device, a crimping device, means for applying an external seal, or the like.

Outer strap guide 120 is stationary and is provided with strap inlet guideway 121 and strap outlet guideway 122 which are in registry with feed guideways 12 and 13, respectively, when winder drum 11 is in normal rest position while strap is fed therethrough. After passing through sealing mechanism 90, strap 19 enters a peripheral strap guideway or chute which loops the strap about the package and which terminates in substantially horizontal guideway portion 20 directing the leading strap end into gripper jaws 21 and 24. Limit switch 23 detects the passing of the leading end of the strap through horizontal guideway 20 and causes reversal of the rotational direction of the prime mover for the strapping machine by the time the aforementioned leading strap end and an overlapping strap portion are in a position to be subsequently gripped and held between gripper jaws 21 and 24.

However, after the aforementioned reversal of rotational direction has taken place, the leading end is first held between holding jaws 16 and 17 while the strap is being wound at a relatively low speed on winder drum 11 for tensioning. In the embodiment shown in the drawings, jaws 17 and 24 are carried on pivotable member 18 which is actuated by cam gear 34; however, any convenient gripping and holding jaw arrangement can be utilized.

Power input to the strap feeding and tensioning mechanism as well as to the gripping and holding jaws is effected via input shaft 22 which is driven by an appropriate reversible motor such as an electric motor or the like. The actuation of the particular mechanisms will be described in greater detail hereinbelow with particular reference to the various gears, cams, springs, and other machine elements which constitute each mechanism.

Strap Feeding and Tensioning Mechanism

Figure 2:
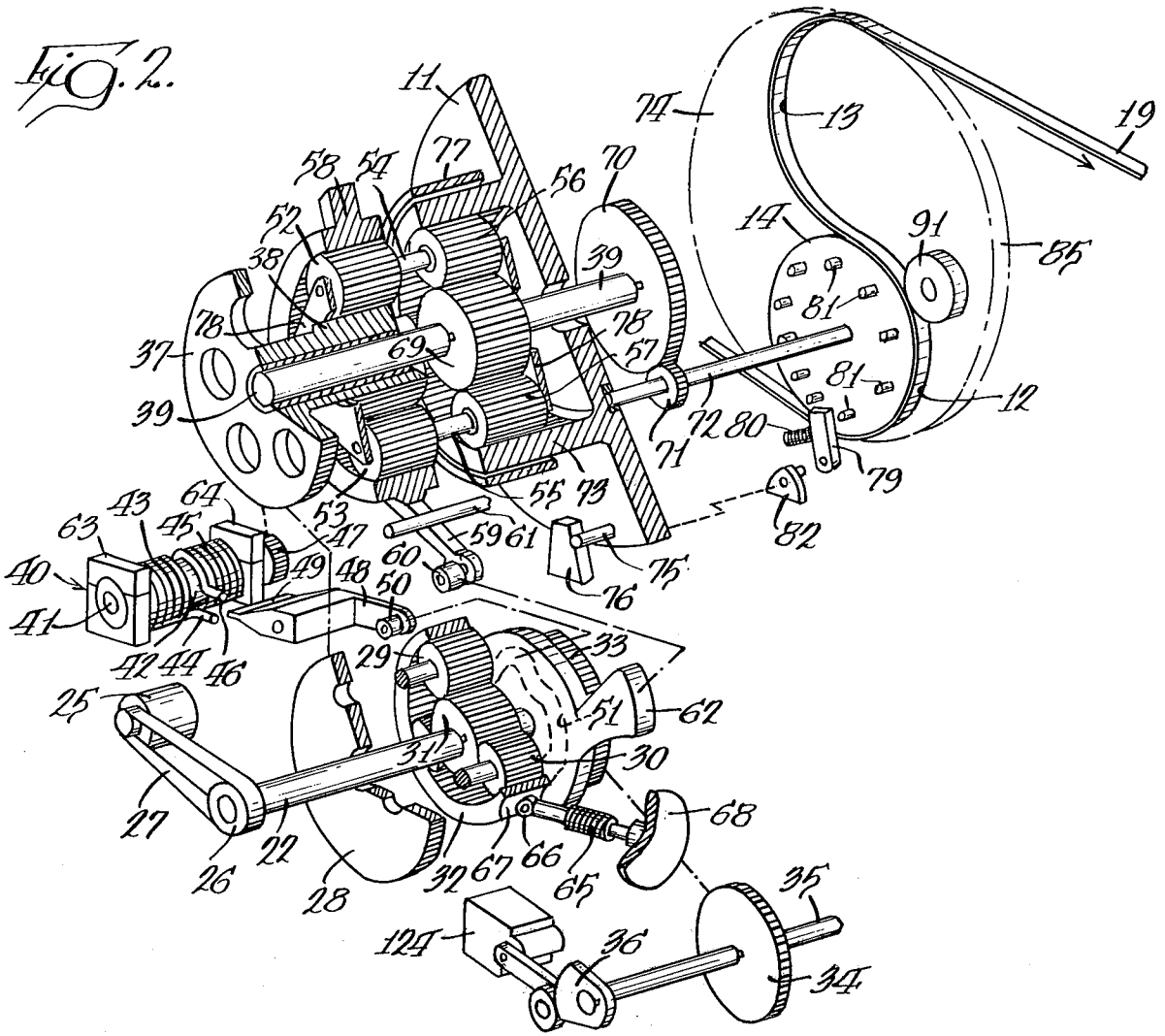
FIG. 2 is a fragmentary perspective view, partially broken away, taken from the rear of the apparatus shown in FIG. 1 and showing an embodiment of the strap feeding and tensioning mechanism.
Figure 3:
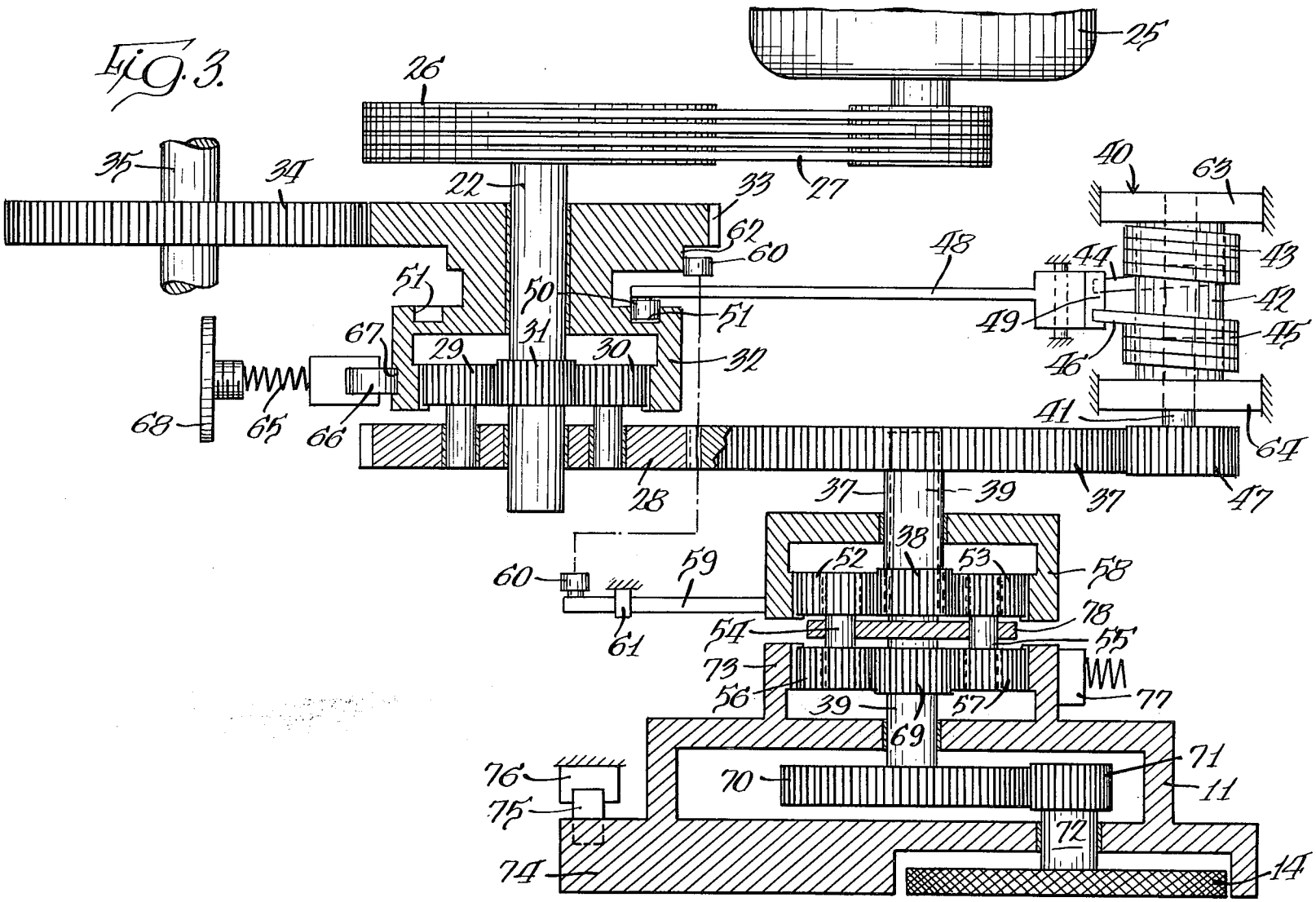
FIG. 3 is a sectional view schematically illustrating a power transmission means to the sealing and tensioning mechanism of the apparatus shown in FIG. 1.

The overall relationship of the machine elements which make up this mechanism is illustrated in FIG. 2 and schematically depicted in FIG. 3. This type of mechanism can be effectively utilized with thermoplastic strap, e.g., polypropylene strap, nylon strap, or the like, as well as with metal strap.

Referring to FIG. 2, the output shaft of reversible electric motor 25 is connected to sheave 26 affixed at one end of input shaft 22 by means of endless belt 27. The strap feeding and tensioning mechanism is actuated by input carrier gear 28 journaled on input shaft 22 and driven through three input planet gears such as planet gears 29 and 30 in FIG. 2 which are journaled in carrier gear 28. Input sun gear 31 is keyed to shaft 22 and drives planet gears 29 and 30. Input planetary ring gear 32 also engages planet gears 29 and 30 at one end of the housing, and is integral with cam drive gear 33 at the other end of the housing. Cam drive gear 33 meshes with cam gear 34 keyed to cam shaft 35 which shaft carries limit switch cam lobe 36 keyed thereto for actuation of limit switch 124 used to return the prime mover such as electric motor 25 to its forward operating mode at the completion of the operating cycle. Input carrier gear 28 drives winder sun gear 38 journaled on feed wheel input shaft 39 by means of winder input gear 37. Winder sun gear 38 and winder input gear 37 are integral with one another.

Transmission lock means 40 comprises transmission lock shaft 41 journaled in stationary mounts 63 and 64 and provided with bi-directional spring clutch 42 which includes clockwise lock spring 43 terminating in lock spring tang 44 and counterclockwise lock spring 45 terminating in lock spring tang 46, as well as lock shaft gear 47 which meshes with winder input gear 37. Transmission lock arm 48 is pivotally mounted on the machine housing and is provided at one end with actuator finger 49 adapted to engage tangs 44 and 46 and on the other end with cam follower 50 which engages transmission lock cam 51 in the housing of input planetary ring gear 32.

Winder sun gear 38 drives three tension release planetary gears, such as planet gears 52 and 53, which share respective common shafts 54 and 55 with winder planetary gears, i.e., planet gears 56 and 57, respectively. All common shafts for both sets of planet gears are carried on the same common planet carrier 78. Tension-release ring gear 58 also meshes with planetary gears 52 and 53, and is provided with integral cam-controlled reaction arm 59 which terminates in cam follower 60 and which serves to release tension on the strap before severing, and after a loop has been formed and tensioned about a package. Reaction arm 59 abuts stop bar 61 during the strap feed cycle. Reaction arm 59 is affixed to the housing of tension release ring gear 58 and carries cam follower 60 which is adapted to engage cam lobe 62 during a portion of the tensioning operation.

The maximum degree of tension to which the strap loop is subjected during tensioning is determined by tension control spring 65 which is a compression spring urging detent roller 66 against tension control cam 67 on the outer surface of input planetary ring gear 32. The degree of compression for spring 65 is determined by tension adjustment knob 68.

Feed wheel input sun gear 69 and feed wheel drive gear 70 are keyed on feed wheel input shaft 39. Three strap winder planetary gears, such as planetary gears 56 and 57 shown in FIG. 2, drive sun gear 69 and thus shaft 39 and drive gear 70. Feed wheel pinion 71 is keyed on shaft 72 which also carries strap feed wheel 14. Drive gear 70 meshes with feed wheel pinion 71 and drives feed wheel 14 through shaft 72 a portion of which is journaled in winder drum 11. Feed wheel 14 and winder drum 11 are positioned relative to one another so that the rotational axis of feed wheel 14 is parallel to but spaced from the rotational axis of winder drum 11. The other end of shaft 72 is journaled in winder face plate 74 which is integral with winder drum 11. Winder planetary ring gear 73 engages planet gears 56 and 57 and is integral with winder drum 11. Pin 75 on winder drum 11 is positioned to abut stop 76 when winder drum 11 is in its home position. Drag brake 77 engages the outer surface of winder planetary ring gear 73 and serves to hold winder drum 11 in the home position, i.e., with pin 75 abutting stationary stop 76 during strap take-up by feed wheel 14 and maintains pre-tension on the strap looped about a package as winder drum 11 is turned to tension the loop. Drag brake 77 is adjusted to begin slipping after a predetermined tension has been pulled on the formed strap loop by high-speed feed wheel 14 rotating in reverse direction during the initial stage of strap tensioning.

The strap feeder planetary gears and the winder planetary gears share common planet carrier 78 which also carries common shafts 54 and 55.

Feed wheel lock pawl 79 is pivotally mounted on boss 82 which is connected to winder drum 11, is biased by spring 80, and is adapted to engage peripheral stop pins 81 on the back face of feed wheel 14 so as to lock feed wheel 14 against rotation in the clockwise direction when winder drum 11 is not in its home position. In the alternative, lock pawl 79 can be made to interact with feed wheel drive gear 70 for the same purpose.

Bias roller or pinch roller 91 is rotatably mounted on winder guide plate 74 so as to project into first arcuate guideway 12 and to urge strap 19 against feed wheel 14. If desired, feed guideway 13 can be provided with a first friction surface 126 along the convex portion thereof for frictionally engaging the strap during tensioning by winder drum 11. Strap diverter means, such as elongated member 83, is pivotally mounted on winder drum face plate 74 near the exit end of guideway 13. Elongated member 83 is biased by spring 84 to direct strap exiting from guideway 13 into guide 122 and guideway 15.

Operation of Strap Feeding and Tensioning Mechanism

Figure 4:
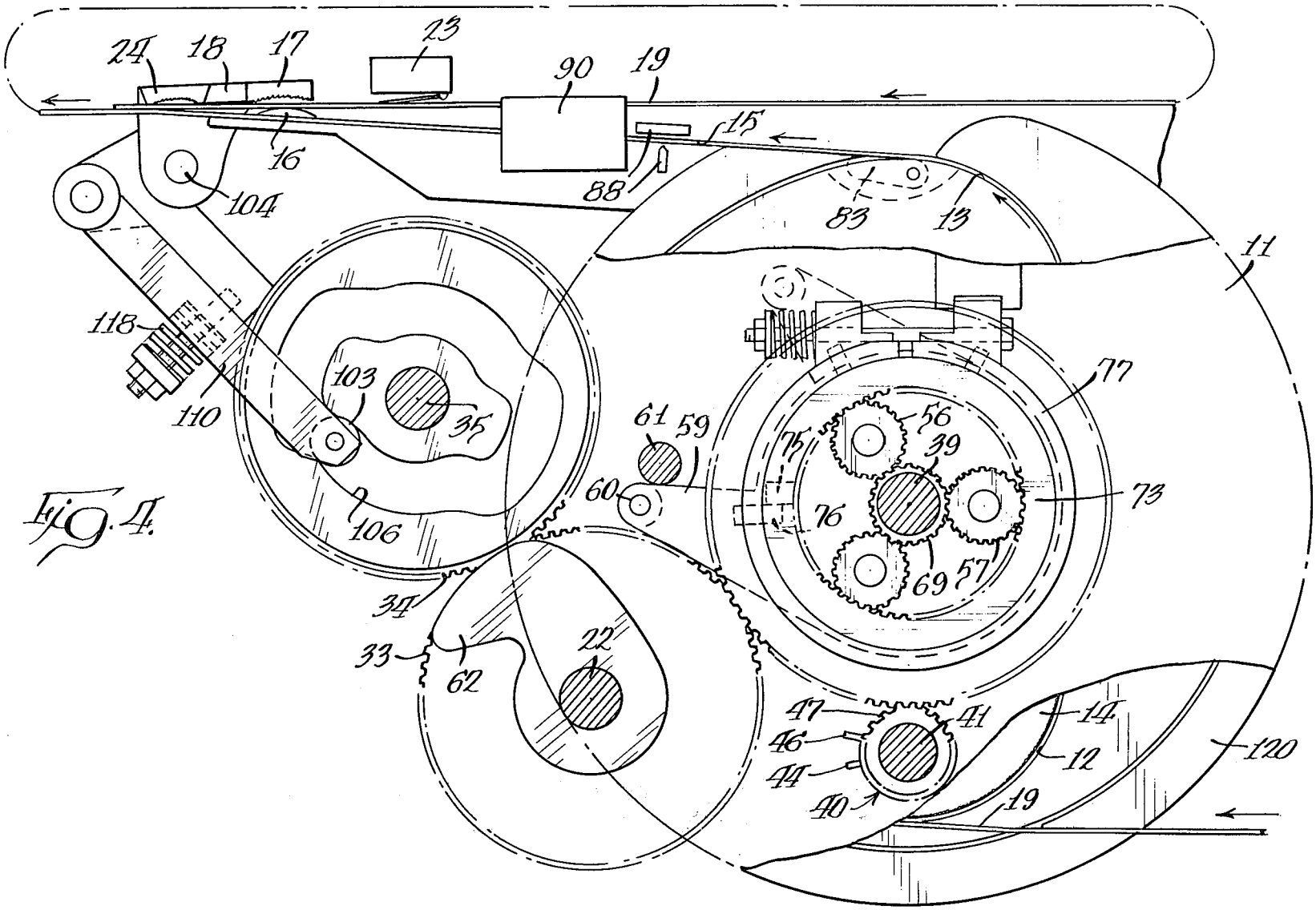
FIG. 4 is an enlarged fragmentary front elevational view, partly broken away, showing the strap feeding and tensioning mechanism during the strap feeding step.
Figure 5:
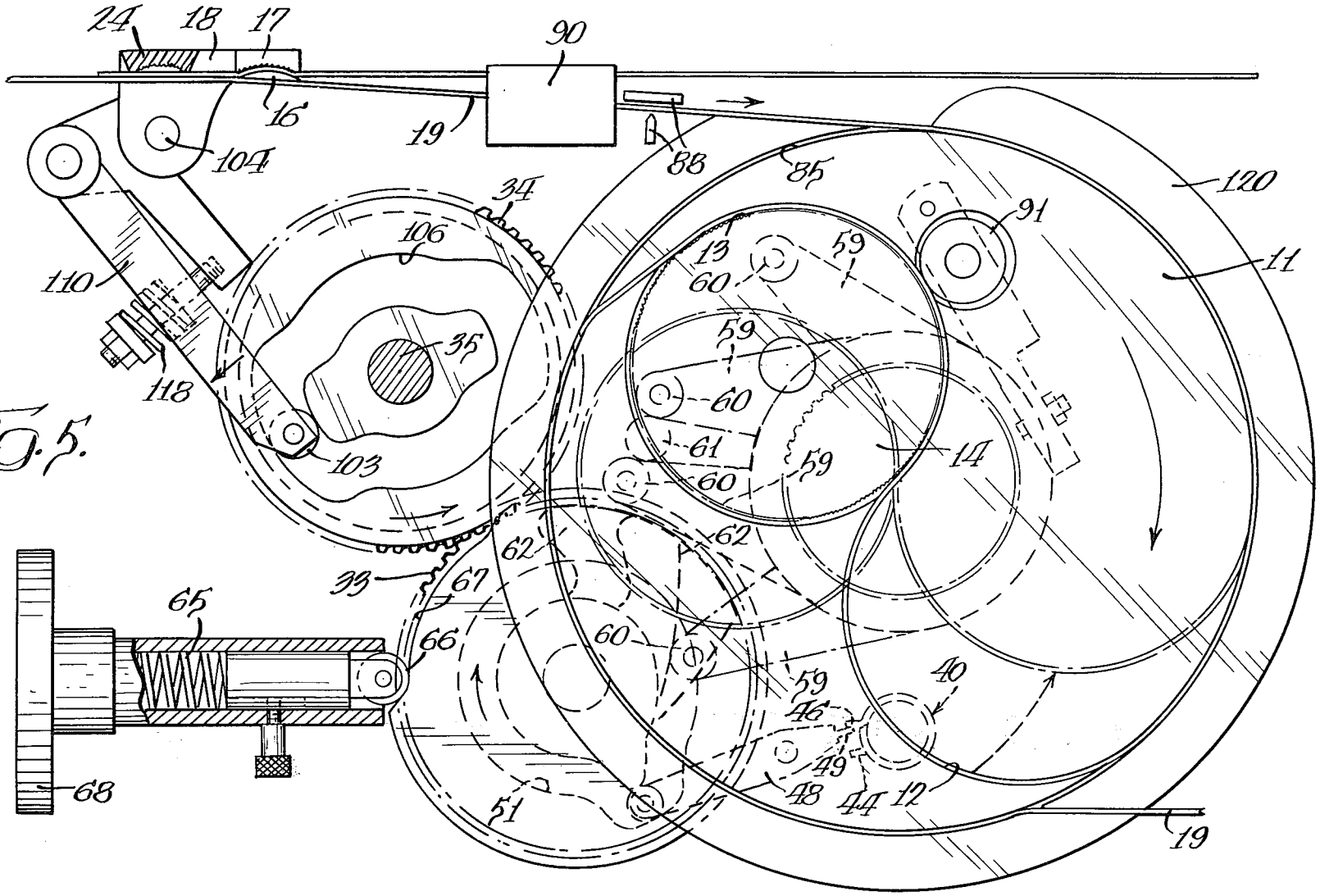
FIG. 5 is an enlarged fragmentary front elevational view similar to FIG. 4 and showing the strap feeding and tensioning mechanism during strap tensioning and subsequent strap relaxation, the position of the various machine elements during strap relaxation being shown in phantom.

Referring to FIGS. 1, 4 and 5, when strapping apparatus 10 is energized at the beginning of a strapping cycle, strap 19 is fed into strap inlet guide 121 and first arcuate strap feed guideway 12, and then engages high-speed feed wheel 14 which is rotating in a clockwise direction at a relatively high speed. Continued rotation of feed wheel 14 at relatively high speed transports strap 19 into and through second arcuate strap feed guideway 13 as set forth hereinabove. Optional pivotable strap diverter 83, biased by coil spring 84, can be utilized adjacent the exit end of guideway 13 to make sure that strap 19 enters strap exit guide 122 and guideway 15. During this time period, winder drum 11 remains stationary. After a strap loop has been formed around the package as determined by limit switch 23, the rotational direction of feed wheel 14 is reversed and feed wheel 14 is driven in reverse at relatively high speed to take up excess slack. Just prior to reversal of feed wheel 14 the leading strap end is held between holding jaws 16 and 17 to permit tensioning.

During strap feed, input planetary gear 32 is in the position shown in FIG. 1 with detent roller 66 engaging tension control cam 67 at the upper end of the detent. Transmission 40 is locked in the counterclockwise direction at this time, so that when direction of rotation is reversed, input planetary gear 32 rotates clockwise about 45° without pushing detent roller 66 outwardly. During this time period cam gear 34 turns and actuates holding jaw carrier arm 110 (FIG. 4) to pivot member 18 about shaft 104 downwardly and cause engagement with the leading end of strap 19. After the leading strap end has been held between holding jaws 16 and 17, continued rotation of input planetary gear 32 pivots transmission lock arm 48 to engage tang 46 and unlock the transmission, thereby allowing feed wheel 14 to reverse and take up slack in the strap that has been fed through winder drum 11.

Figure 6:
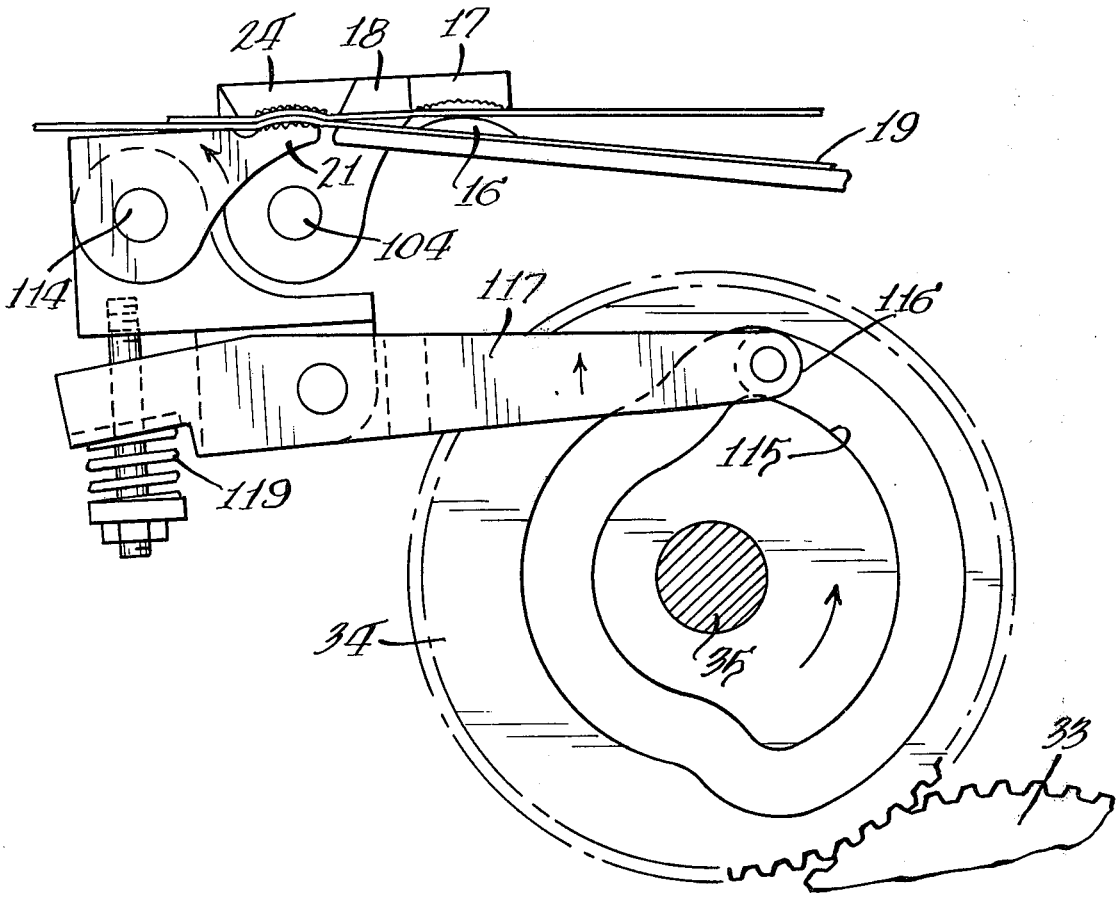
FIG. 6 is an enlarged fragmentary front elevational view showing the strap gripper position after the strap loop has been tensioned about the package.

When the excess strap has been taken up by the high-speed reverse rotation of feeder wheel 14, winder drum 11 is rotated in a clockwise direction so as to tension the formed strap loop about the package by winding strap 19 around outer peripheral surface 85 of winder drum 11. If desired, at least a portion of surface 85 can be a friction surface, i.e., a second friction surface such as surface 127 which is knurled or otherwise treated to provide a coefficient of friction sufficiently high to prevent slippage of strap during tensioning. Once the predetermined degree of tension has been attained, detent roller 66 (FIG. 5) releases input planetary gear 32 thus permitting cam gear 34 to turn and to actuate tension-holding gripper jaws 21 and 24 so as to receive overlying strap portions into holding engagement with gripping jaws 21 and 24 (FIG. 6). At this stage, the strap loop around the package is fully tensioned and ready to be severed from the strap supply roll and subsequently sealed by fusing together superimposed portions of the strap, or in any other convenient manner, e.g., by crimping a sealing element thereabout.

To avoid shattering the strap at the point of severance in the case of plastic strap, tension must be released in the strap segment which is not part of the tensioned loop before the strap is cut. Thus, once gripper jaws 21 and 24 are in the position shown in FIG. 6 and cam lobe 62 has moved a sufficient distance to release cam-controlled reaction arm 59 (FIGS. 2 and 5), reverse rotation of winder drum 11 to the position shown in phantom takes place, thereby releasing tension in that portion of strap 19 which is outside of the tensioned loop. Transmission lock 40 simultaneously holds tension until the point in time when tension is released by means of reaction arm 59.

Convenient strap severing means can be provided by mounting appropriate cutter means 88 in proximity of sealing or joining means 90, or the strap can be cut off by hand if desired.

For gripper jaw 21, cam follower 116 carried by arm 117 engages cam surface 115 in cam gear 34 (FIG. 6). Arm 117 pivots on shaft 114 and is operably connected to gripper jaw 21 so that jaw 21 will move in response to movement by carrier arm 117. Pressure spring 119 urges cam follower 116 in contact with cam surface 115. Similarly, for actuation of holding jaw 17, cam follower 103 (FIG. 4) mounted on arm 110 engages camming surface 106 provided on cam gear 34 so that member 18, and thus jaw 17, can be pivoted on shaft 104 as needed during the operating cycle. Pressure spring 118 urges cam follower 103 in contact with cam surface 106.

Strapping and Sealing Cycle

To strap and subsequently seal the strap loop about a package, electric motor 25 is energized by closing an appropriate start switch (not shown). Power input to shaft 22 (FIG. 3) is transmitted through the three input planetary gears such as planet gears 29 and 30 and through input carrier gear 28 to winder input gear 37. Input planetary ring gear 32 is stationary at this time because of the action of detent roller 66, and transmission lock arm 48 holds down tang 44 permitting only clockwise rotation of lock shaft gear 47. Tension control spring 65 urges detent roller 66 into the detent groove of detent cam 67, thereby preventing movement of input planetary ring gear 32.

The resultant counterclockwise rotation of winder input gear 37 drives feed wheel 14 in a clockwise direction through the winder planet gears such as planetary gears 52 and 53, and through the strap feeder planetary gears 56 and 57. Feed wheel input sun gear 69 is, in turn, driven by the strap feeder planetary gears and thus drives input shaft 39 which, in turn, drives feed wheel 14 through drive gear 70 and pinion 71. Winder planetary ring gear 73 tends to move in a counterclockwise direction as a result, but is held in place by pin 75 which is abutting stop 76. Likewise, the tendency of tension release ring gear 58 is to rotate in a clockwise direction; however, reaction arm 59 abuts stop bar 61 and prevents rotation.

Strap 19, fed into first arcuate guideway 12 of winder drum 11 via strap inlet guideway 121, contacts rotating feed wheel 14 and is transported through drum 11 via arcuate guideways 12 and 13 (FIG. 1). Bias or pinch roller 91 assures good contact between strap 19 and feed wheel 14. Thereafter strap 19 enters strap guideway 15 via strap exit guideway 122 which directs the strap through strap sealing mechanism 90 and holding jaws 16 and 17, and then into a peripheral strap guideway which directs the strap about a package to be strapped so as to form a loop. The leading end of strap 19 is returned to the sealing mechanism via substantially horizontal peripheral strap guideway portion 20. The passing of leading strap end is detected by limit switch 23 whereupon switch 23 causes reversal of electric motor 25 by the time the leading strap end arrives between gripper jaws 21 and 24.

Upon reversal of motor 25, cam drive gear 33 and cam gear 34 begin to turn as explained before, the leading end of the strap is gripped between holding jaws 16 and 17, transmission lock arm 48 shifts to release tang 44, and feed wheel 14 rapidly removed excess strap from the peripheral strap guideway while transmission lock means 40 only permits counterclockwise rotation of feed wheel 14. The tendency of winder drum 11 at this time is to move away from stop 76; however, the action of drag brake 77 against the outer surface of winder planetary ring gear 73 prevents such movement. When the strap being taken up becomes taut and is drawn to a predetermined tension, drag brake 77 begins to slip and feed wheel 14 stops. The tension in a given instance depends on the brake setting for the particular strap that is being used. At the same time, winder drum 11 begins to rotate slowly in a clockwise direction pulling strap against, and in frictional engagement with, the convex surface of second arcuate strap guideway 13 and winding strap around the outer peripheral surface of drum 11. The relatively large gear reduction to winder drum 11 provides considerable torque for tensioning the strap, and the relatively large diameter of winder drum 11 provides substantially straight line pull on the strap during tensioning, thereby minimizing the tendency of plastic strap to scuff or delaminate. As tension builds up into the strap, frictional drag of the strap against arcuate guideway 13 increases, thereby preventing the strap from slipping back as drum 11 continues to turn. This function can be enhanced by the provision of the optional feed wheel lock pawl 79 discussed hereinabove. If desired, the convex surface of guideway 13 can be made so as to have a relatively high coefficient of friction to assist in the strap tensioning. Such a high frictional drag surface will not interfere with the strap feeding operation because at that time the strap passing through winder drum 11 hugs the opposite, concave surface of guideway 13.

As drum 11 rotates, further increase in strap tension pulls reaction arm 59 downwardly; however, inasmuch as cam lobe 62 (FIG. 2) at this point in time is positioned immediately below cam follower 60 carried by arm 59, the downward movement of arm 59 is limited. When a predetermined maximum tension is achieved, as determined by the setting of tension adjustment knob 68, detent roller 66 is cammed out, input planetary ring gear 32 and thus cam drive gear 33 begin to turn actuating cam gear 34. Cam surface 115 on cam gear 34 (FIG. 6) causes gripper jaw 21 to close against jaw 24 so as to hold tension in the formed strap loop. Shortly thereafter holding jaws 16 and 17 are opened, releasing the previously held leading strap portion.

As cam lobe 62 continues to rotate in a clockwise direction, reaction arm 59 moves downwardly and winder drum 11 begins to rotate in a counterclockwise direction because of the tension in the strap, thus releasing tension on that portion of the strap which is not part of the tensioned loop. At this time, both tangs 44 and 46 of transmission lock means 40 are released, thereby locking winder input gear 37 in both directions. Of course, inasmuch as winder input gear 37 is locked, input carrier gear 28 meshing with input gear 37 is also locked and the power flow from input shaft 22 is through input sun gear 31, through the three input planet gears such as gears 29 and 30 (FIG. 2), and through input planetary ring gear 32 which drives cam shaft 35 through cam drive gear 33 and cam gear 34. After the tension has been released in that portion of the strap which is not part of the loop, the strap is severed. Alternatively, the strap loop can be sealed first, the tension then released, and the formed loop subsequently severed from the strap supply roll.

The duration of the combined strapping cycle can vary, dependent on the speed at which the apparatus of this invention is driven. However, feeding and tensioning cycles having a duration of the order of about one second are readily obtainable.

The foregoing specification and the drawings are intended as illustrative of this invention and are not to be taken as limiting. Still other variations and rearrangements of parts are possible without departing from the spirit and scope of the present invention.

I claim:

1. Apparatus for forming a tensioned loop of strap about a package which comprises
a frame;
peripheral strap guideway means on said frame for directing strap from a strap supply roll about a package so as to form a loop;
rotatable winder drum means mounted on said frame;
a feed wheel means receiving the strap thereabout and rotatably mounted on said winder drum means;
first feed guideway means in said winder drum means for receiving and directing the strap into engagement with said feed wheel means;
second feed guideway means in said winder drum means for guiding the strap out of engagement with said feed wheel and out of said winder drum means;
gripping means for holding leading strap end payed out from said strap supply roll and said peripheral strap guideway means;
drive means for reversibly driving said feed wheel means; and
means for driving said winder drum means so as to wrap strap about said drum means to tension said loop about said package.

2. The apparatus in accordance with claim 1 wherein a stationary annular ring surrounds said winder drum means and is positioned in a spaced relationship to the peripheral surface of said winder drum means; and wherein a strap inlet guideway means and a strap outlet guideway means are provided in said annular ring in respective registry with said first feed guideway means and with said second feed guideway means.

3. The apparatus in accordance with claim 2 wherein a spring-biased, pivotally-mounted elongated member is mounted on said winder drum means at the strap exit from said second feed guideway means for diverting strap into said strap outlet guideway means in said stationary annular ring.

4. The apparatus in accordance with claim 1 wherein a roller means is rotatably mounted on said winder drum means so as to project into said first feed guideway means and to urge strap within said first feed guideway means against said feed wheel means.

5. The apparatus in accordance with claim 1 wherein a first friction surface is provided along a portion of said second feed guideway means for frictionally engaging the strap when said winder drum means is rotated to wind strap about the peripheral surface of said winder drum means while said gripping means holds said leading strap end.

6. The apparatus in accordance with claim 5 wherein a second friction surface is provided along at least a portion of the strap-carrying periphery of said winder drum means.

7. The apparatus in accordance with claim 1 wherein said first and second feed guideway means are arcuate and have opposite curvatures.

8. The apparatus in accordance with claim 7 wherein a convex surface of the second arcuate feed guideway means is adapted for frictional engagement of the strap when the winder drum is rotated to tension the strap about said package.

9. The apparatus in accordance with claim 1 wherein said feed wheel means is mounted on said winder drum means so that the axis of rotation for said feed wheel means is spaced from and is substantially parallel to the axis of rotation for said winder drum means.

10. A method of feeding strap about a package at a relatively high rate to form a loop and thereafter tensioning the formed loop about the package at a relatively lower rate comprising the steps of
directing a strap to a stationary winder drum and about a high-speed wheel rotatably mounted on said winder drum;
driving said high-speed feed wheel at a relatively high rate;
feeding strap about said high-speed wheel so as to form a loop about a package and provide overlapping strap portions at one portion of the loop;
terminating the strap feeding when a sufficient length of strap has been payed out to form said loop about the package;
holding the leading end portion of the strap looped about the package; and
thereafter rotating said winder drum at a relatively slow rate to pull tension in the strap forming the loop by winding the strap about the drum.

11. The method in accordance with claim 10 wherein said high-speed feed wheel is driven in the reverse direction for a time period sufficient to take up slack in the payed out strap after strap feeding is terminated and before rotation of said winder drum is commenced.

12. The method in accordance with claim 10 wherein overlapping portions of the strap forming the loop are sealed after tensioning.

13. A strapping and sealing apparatus for providing a tensioned loop of strap about a package which comprises
a frame;
strap guideway means on said frame for directing strap from a strap supply roll about a package;
rotatable winder drum means carried on said frame;
a feed wheel means receiving strap thereabout and rotatably mounted on said winder drum means;
first feed guideway means in said winder drum means for receiving and directing the strap into engagement with said feed wheel means;
second feed guideway means in said winder drum means for guiding the strap out of engagement with said feed wheel means, and toward said strap guideway means;
drive means for reversibly driving said feed wheel means at a relatively high rate;
means for driving said winder drum means at a relatively slow rate so as to wrap strap about said drum means to tension said loop about said package;
positioning means for locating a portion of tensioned strap loop in an overlapping relationship relative to an untensioned strap end portion; and
sealing means for joining together the overlapped strap portions after said loop has been formed and tensioned.

14. The apparatus in accordance with claim 13 wherein a stationary outer strap guide means envelops the strap-carrying periphery of said winder drum means; and wherein a strap inlet guideway and a strap exit guideway are provided in said stationary outer strap guide means; said strap inlet guideway being in juxtaposition with the strap entrance of said first feed guideway means and said strap exit guideway being in juxtaposition with the strap exit of said second feed guideway means when said winder drum means is in the normal rest position while strap is fed therethrough.

15. The apparatus in accordance with claim 14 wherein a strap diverter means is pivotally mounted on said winder drum means at the strap exit from said second arcuate feed guideway means to direct strap to said strap exit guideway.

16. The apparatus in accordance with claim 13 wherein a pinch roll biased for engagement with said feed wheel means is rotatably mounted on said winder drum means and projects into the passageway defined by said first feed guideway means.

17. The apparatus in accordance with claim 13 wherein a first friction surface is provided along a portion of said second feed guideway means for frictionally engaging the strap when the winder drum is rotated to wind strap about the peripheral surface thereof so as to tension the strap looped about the package.

18. The apparatus in accordance with claim 13 wherein a second friction surface is provided along at least a portion of the strap-carrying periphery of said winder drum means.

* * * * *